United States Patent [19]

Capp et al.

[11] Patent Number: 4,850,905

[45] Date of Patent: Jul. 25, 1989

[54] STRIP OF ELECTRICAL CONTACTS

[75] Inventors: Randolph E. Capp; Ronald C. Laudig, both of Mechanicsburg; George W. Michael, III, Harrisburg, all of Pa.

[73] Assignee: AMP Incorporated, Harrisburg, Pa.

[21] Appl. No.: 151,130

[22] Filed: Feb. 1, 1988

[51] Int. Cl.[4] ..... H01R 4/70

[52] U.S. Cl. ..... 439/885; 29/863; 29/883; 29/884; 206/330

[58] Field of Search ..... 29/857, 861, 863, 748, 29/753, 883, 884; 206/328, 330; 264/40.5, 40.1, 255, 308; 439/885

[56] References Cited

U.S. PATENT DOCUMENTS

| | | | |
|---|---|---|---|
| 2,963,775 | 12/1960 | Chadwick | 439/885 |
| 3,163,485 | 12/1964 | Kruitwagen et al. | 439/885 |
| 3,634,817 | 1/1972 | Wise . | |
| 4,080,148 | 3/1978 | Wise | 425/576 |
| 4,149,768 | 4/1979 | Wise . | |
| 4,159,300 | 6/1979 | Wise | 264/278 |
| 4,193,658 | 3/1980 | Dittmann et al. . | |
| 4,309,370 | 1/1982 | Sizemore et al. | 264/40.5 |
| 4,398,337 | 8/1983 | Yamaguti et al. | 24/863 |

FOREIGN PATENT DOCUMENTS

| | | | |
|---|---|---|---|
| 1415894 | 12/1975 | United Kingdom | 439/885 |

OTHER PUBLICATIONS

Amp "Modular Interconnection System" Catalog 78-515 Rev. 3-86-1 p.
Modular plug on strip sample.

*Primary Examiner*—Timothy V. Eley
*Assistant Examiner*—Taylor J. Ross

[57] ABSTRACT

A method and apparatus for attaching electrical contacts (23, 24) to the ends of electrical conductors (50). The method of the invention comprises the steps of providing a plurality of contacts (23, 24) at spaced locations along a flexible strip (22), feeding the strip (22) to an attachment station (14) for delivering contacts (23, 24) to the attachment station (14), attaching a contact (23, 24) to the end of an electrical conductor (50) in the attachment station (14), and separating the attached contact (23, 24) from the stip (22). The contacts (23, 24) are incorporated into contact assemblies (20, 20') which comprise a contact (23, 24) having dielectric insulating member (25) molded therearound and molded integral with the flexible strip (22). After attachment of a contact (23, 24) to a conductor, the attached contact assembly (20, 20') is cut from the strip (22) and the strip (22) is indexed to deliver the next contact assembly (20, 20') to the attachment station (14).

11 Claims, 1 Drawing Sheet

STRIP OF ELECTRICAL CONTACTS

BACKGROUND OF THE INVENTION

The present invention relates generally to the field of electrical connectors, and, more particularly, to a method and apparatus for attaching electrical contacts to the ends of electrical conductors.

A coaxial electrical connector generally comprises an assembly which includes an electrically conductive center contact, an electrically conductive outer shell and a dielectric insulating body for supporting the center contact within and for electrically insulating the center contact from the outer shell. The connector is typically assembled by inserting the center conductor of a coaxial electrical cable axially into a conductor-receiving passageway of the center contact and then crimping the center contact around the conductor to secure the contact to the conductor. The attached contact is then inserted axially into the dielectric insulating body either before or after the insulating body is positioned within the outer shell.

Attachment of the center contact to the center conductor of the coaxial cable is usually performed by hand by relatively skilled personnel using a hand-held crimping tool and other appropriate equipment, and is an inefficient process which is not fully satisfactory in a high speed, mass production environment.

SUMMARY OF THE INVENTION

The present invention provides a method and apparatus for attaching contacts to the ends of electrical conductors in an efficient, substantially automated manner. The method of the invention comprises the steps of providing a plurality of contacts at spaced locations along a flexible strip, feeding the strip to an attachment station for delivering contacts to the attachment station, attaching a contact to the end of an electrical conductor in the attachment station, and separating the attached contact from the strip.

According to a presently preferred embodiment of the invention, each of the plurality of contacts is supported within a dielectric insulating member positioned around the back end thereof to define a contact assembly; and the dielectric insulating members are molded integral with and are positioned at equally spaced locations along a continuous flexible strip. The continuous strip of spaced contact assemblies is rolled up on a spool and reeled out as required to deliver contact assemblies to the attachment station during operation of the apparatus.

The attachment station includes a crimping tool and a cutting mechanism. When a contact assembly is positioned in the attachment station, an electrical conductor is inserted axially into the contact thereof, and the crimping tool is actuated to crimp the contact to the conductor. Substantially simultaneously with or immediately after the crimping step, the cutting mechanism is actuated to cut the contact assembly from the continuous strip. The attached contact assembly is then removed from the attachment station and the next contact assembly on the continuous strip is delivered thereto.

According to an important aspect of the invention, the dielectric insulating member of each contact assembly is of generally cylindrical cross section but includes a pair of diametrically opposed flat surface portions to which sections of the continuous strip are integrally connected. The cutting mechanism comprises a pair of cutting blades which are actuated to cut both sides of the contact assembly from the strip sections substantially along the lines of intersection of the strip sections and the flat surface portions of the dielectric insulating member. The flat surface portions facilitate cutting of the contact assemblies from the strip sections closely adjacent the lines of intersection of the strip sections and the dielectric insulating member; and help ensure that any small portions of the strip that do remain attached to the contact assembly after cutting will be within the envelope of the cylinder defined by the cylindrical shape of the insulating member and will not interfere with the proper positioning of the contact assembly into an outer shell during assembly of the connector.

According to a further aspect of the invention, the continuous flexible strip includes a plurality of pilot holes at spaced locations therealong which are adapted to be engaged by a motor-driven toothed wheel to feed the continuous strip to the attachment station to deliver the contact assemblies thereon one-at-a-time to the attachment station. The pilot holes are defined by two intersecting recesses formed on opposite sides of the strip and extending from opposite edges of the strip. The intersecting recesses permit the pilot holes to be formed during molding of the strip in a manner which avoids the necessity for any camming action in the mold components transverse to the direction of opening and closing of the mold components thus simplifying mold construction and increasing mold reliability.

With the present invention, electrical contacts are secured to the ends of conductors of electrical cables in an efficient, substantially automated manner with only minimum operator involvement and without the need for highly skilled personnel. The method and apparatus of the invention thus provide a significant reduction in manufacturing costs.

Further important advantages and specific details of the invention will become apparent hereinafter in conjunction with the following detailed description of a presently preferred embodiment.

DETAILED DESCRIPTION OF THE PREFERRED EMBODIMENT

Figures 1, 2, 3A, 3B, 3C, 4:
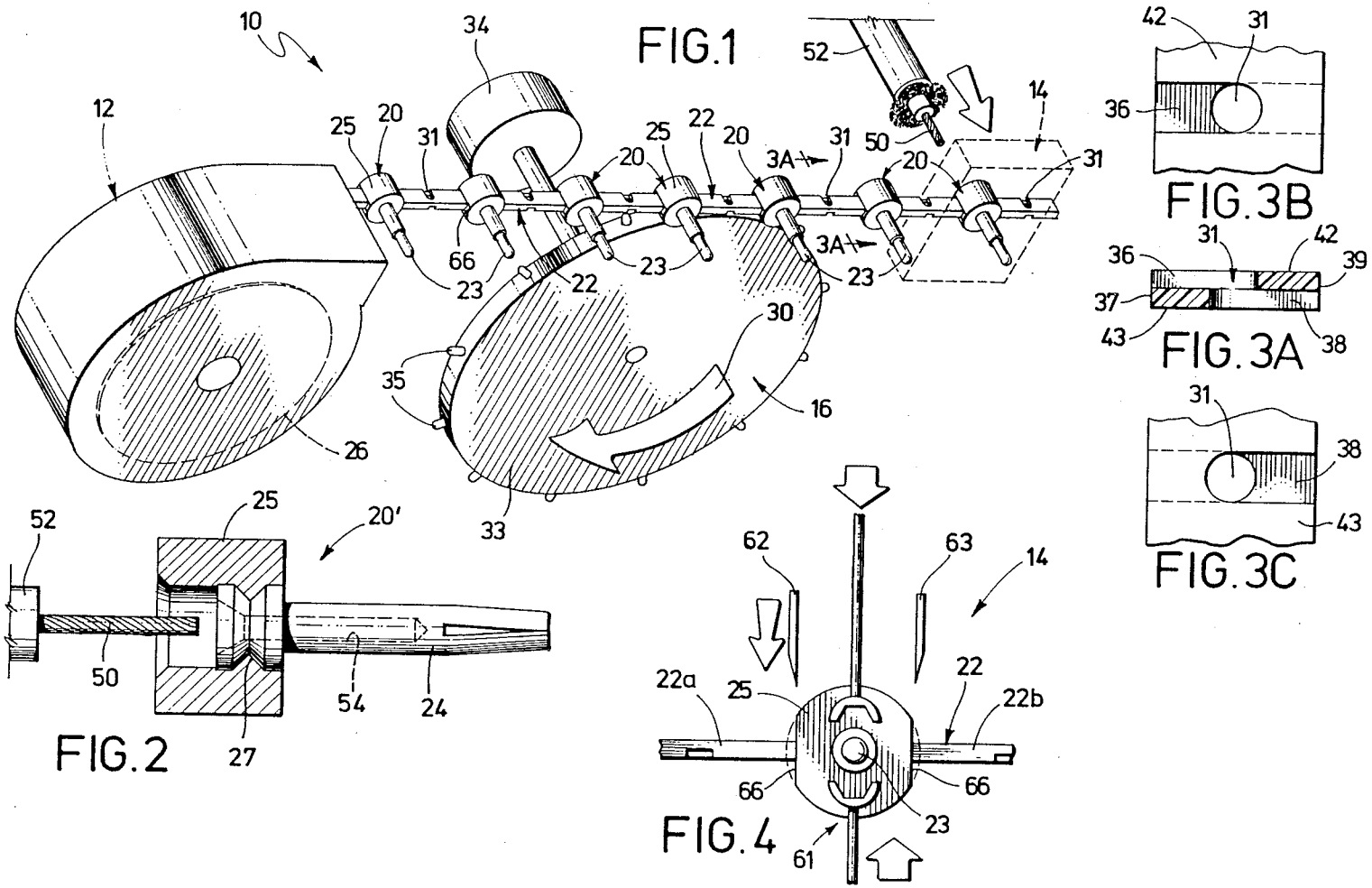
FIG. 1 schematically illustrates a system for attaching contacts to the ends of electrical conductors according to a presently preferred embodiment of the invention.
FIG. 2 is a cross-sectional view of a modified contact assembly which may be used in the system of FIG. 1.
FIG. 3A is a cross-sectional view and FIGS. 3B and 3C are top and bottom views, respectively, of the flexible strip of FIG. 1.
FIG. 4 schematically illustrates the details of the attachment station of the system of FIG. 1.

FIG. 1 schematically illustrates a system for attaching electrical contacts to the ends of electrical conductors according to a presently preferred embodiment of the invention. The system is generally designated by reference numeral 10 and includes a contact supply station 12 storing a supply of electrical contacts 23, an attachment station 14 in which the contacts are attached to the ends of electrical conductors, and a feeding mechanism, generally designated by reference numeral 16, for feeding contacts from the supply station to the attachment station.

In the embodiment of FIG. 1, contacts 23 comprise center contacts and each center contact is incorporated within a contact assembly 20 which comprises a center contact 23 supported within a dielectric insulating member 25 positioned around the back end thereof. As will be explained hereinafter, the center contact of each contact assembly 20 is adapted to be attached to the end of a center conductor 50 of a coaxial electrical cable 52 in attachment station 14, and the attached assembly is thereafter adapted to be inserted into and secured within the outer shell of an electrical connector during assembly of the connector. The connector itself does not form a part of the present invention, however, connectors incorporating contact assemblies 20 are illustrated and described in detail in commonly assigned copending application Ser. No. 071150820 filed on Feb. 1,1988 now U.S. Pat. No. 4,795,352.

In the embodiment illustrated in FIG. 1, contacts 23 comprise male pin contacts. Alternatively, the contacts can comprise female receptacle contacts 24 incorporated in a contact assembly 20' as shown in FIG. 2.

Supply station 12 comprises a plurality of contact assemblies 20 (or contact assemblies 20') carried on a continuous flexible strip 22. More particularly, the contact assemblies 20 are formed by molding the dielectric insulting members 25 around the back ends of the contacts 23 (or 24) in a molding apparatus which simultaneously forms the assemblies in groups along molded strip segments of finite length, and then joins the molded strip segments together by an over-molding process to provide a continuous strip of serially arranged contact assemblies integral with and equally spaced along the length of strip 22. The holding apparatus also does not form a part of the present invention, but can be similar to the apparatus described in commonly assigned U.S. Pat. No. 4,309,370 of Sizemore et al., the disclosure of which is herein incorporated by reference.

After the continuous strip of contact assemblies is formed, it is preferably rolled up on spool schematically illustrated at 26 and positioned within supply station 12 of system 10 as shown in FIG. 1. As best shown in FIG. 2, the contacts are preferably shaped to define an annular groove or recess 27 around the back ends thereof to help ensure that the molded members 25 are securely attached to the contacts following the molding operation.

As shown in FIG. 1, continuous strip 22 also includes a plurality of pilot holes 31 positioned at equally spaced locations along the length of the strip. The pilot holes are used in conjunction with the feeding mechanism 16 to feed the continuous strip from spool 26 in supply station 12 to the attachment station 14 to deliver contact assemblies to the attachment station. More particularly, the feeding mechanism 16 includes a wheel 33 having a plurality of teeth 35 around its periphery which are adapted to engage the pilot holes 31 and to drive the continuous strip forwardly as the wheel is rotated in a clockwise direction as indicated by arrow 30 in FIG. 1 to deliver contact assemblies 20 to the attachment station 14. The toothed wheel 33 is preferably driven by a stepping motor 34 to deliver the contact assemblies to the attachment station one-at-a-time in stepwise fashion and to accurately position the contact assemblies in the attachment station.

The pilot holes 31 are preferably formed from two intersecting recesses formed on opposite sides of the strip 22 and extending from opposite edges of the strip. More particularly, as shown in FIGS. 3A, 3B and 3C, a first recess 36 is formed in the top surface of the strip and extends from one edge 37 of the strip for a distance slightly greater than halfway across the strip. A second recess 38 is formed in the bottom surface of the strip and extends from the opposite edge 39 of the strip for a distance slightly greater than halfway across the strip. A pilot hole 31 which extends through the strip from the top surface 42 to the bottom surface 43 thereof, is formed where the two slots 36 and 38 intersect in the center of the strip as best shown in FIG. 3A.

By forming the pilot holes 31 with intersecting recesses 36 and 38, the molding apparatus in which the continuous strip is formed is simplified to the extent that it becomes unnecessary to provide a camming action in the molding apparatus which is transverse to the direction of opening and closing of the mold components.

As shown in FIG. 1, feeding mechanism 16 is adapted to position each contact assembly in attachment station 14 with the contact assembly oriented substantially horizontally such that the contact 23 (or 24) thereof extends forwardly therein. The contact of the contact assembly in the attachment station is then attached to the end of a center conductor 50 of a coaxial electrical cable 52 by inserting the exposed end of the conductor 50 into the conductor-receiving opening 54 of the contact through the open rear end thereof (see FIG. 2), and then crimping the contact to the conductor.

More particularly, when conductor 50 is fully inserted into conductor-receiving opening 54 of the center contact, preferably by hand, a crimping tool 61, schematically illustrated in FIG. 4, is actuated to surround and engage the contact to crimp the contact around the conductor to attach the contact thereto. The crimping tool 61 may be of generally conventional type and is not described in detail herein.

During or immediately after crimping of the contact to conductor 50, a pair of cutting knives 62 and 63 are actuated to cut the attached contact assembly from the continuous flexible strip 22. As best shown in FIG. 4, the dielectric insulating member 25 of each contact assembly 20 is of generally cylindrical cross-section but includes a pair of diametrically opposed flat surface portions 66 to which the continuous strip sections **22*a* and 22*b* of strip 22 are integrally attached. As shown in FIG. 4, the flat surface portions 66 are of a length somewhat greater than the thickness of the strip, and the knives 62 and 63** are positioned to cut the contact assembly from the continuous strip sections substantially along the lines of intersection of the strip sections and the flat surface portions on the insulating member.

The flat surface portions 66 on the dielectric insulating member facilitate cutting of the contact assemblies from the continuous strip sections by ensuring that the assemblies are cut substantially cleanly from the strip sections with little or no portions of the strip sections remaining attached to the contact assembly. Any portion of the strip sections that does remain attached to member 25 after cutting will be sufficiently small such that it will be within the envelope of the cylinder defined by the cylindrical-shaped member (shown in dotted line in FIG. 4), and not interfere with proper positioning of the contact assembly in the outer shell of a connector body.

After a contact assembly has been cut from the continuous strip, the contact assembly is removed from the attachment station and the feeding mechanism 16 is actuated to move the next contact assembly on strip 22 into the attachment station to be crimped and cut.

With the present invention, a method and apparatus is provided by which electrical contacts are attached to the ends of conductors in an efficient, substantially automated manner with only minimal operator involvement. The system is highly reliable and permits a significant reduction in labor costs.

While what has been described constitutes a presently preferred embodiment of the invention, it should be recognized that the invention could take numerous other forms. For example, the structure for cutting the contact assemblies from the continuous strip can comprise a pair of blades or other cutting means which operate simultaneously as illustrated in FIG. 4, or a single movable blade which first cuts one side and then the other side of the contact assembly from the strip. Also, the feeding mechanism for feeding the continuous strip to the attachment station can take many other forms. Because the invention can take many forms, it should be recognized that the invention should be limited only insofar as is required by the scope cf the following claims.

We claim:

1. An electrical contact assembly for positioning in an electrical connector body and for connection to an electrical conductor comprising:

a conductive electrical contact having a back end, an annular recess around the back end, a dielectric insulating member encircling the back end and securely attached in the annular recess, an opening in the dielectric member communicating with a conductor receiving opening in the back end, the periphery of the dielectric member is within an envelope, detachable dielectric strip segments joined to and extending from sides of the dielectric member, the sides are recessed within the envelope for permitting portions of the strip segments that remain attached to the dielectric body after detaching the strip segments from the dielectric body to remain also within the envelope, so as not to interfere with positioning of the contact assembly within an electrical connector body.

2. An electrical contact assembly, as recited in claim 1, and comprising:

the dielectric member is cylindrical, and the flat surfaces are diametrically opposed.

3. An electrical contact assembly, as recited in claim 1, and comprising:

the sides are flat for cutting therealong to detach the strips.

4. An electrical contact assembly, as recited in claim 1, and comprising:

pilot holes in corresponding strip segments, each pilot hole being formed by two recesses extending along opposite sides of the strip and intersecting each other.

5. An electrical contact assembly, as recited in claim 4, and comprising:

the dielectric member is cylindrical, and the flat surfaces are diametrically opposed.

6. An electrical contact assembly, as recited in claim 4, and comprising:

the sides are flat for cutting therealong to detach the strips.

7. An electrical contact assembly, as recited in claim 4, and comprising:

the recesses intersect each other along the center of the strip.

8. An electrical contact assembly, as recited in claim 7, and comprising:

the dielectric member is cylindrical, and the flat surfaces are diametrically opposed.

9. An electrical contact assembly, as recited in claim 7, and comprising:

the sides are flat for cutting therealong to detach the strips.

10. An electrical contact assembly for positioning in an outer shell of an electrical connector body and for connection to an electrical conductor comprising:

a conductive electrical contact having a back end, an annular recess around the back end, a dielectric insulating member encircling the back end and securely attached in the annular recess, an opening in the dielectric member communicating with a conductor receiving opening in the back end, detachable dielectric strip segments joined to and extending from sides of the dielectric member, pilot holes in corresponding strip segments, each pilot hole being formed by two recesses extending along opposite sides of the strip and intersecting each other.

11. An electrical contact assembly, as recited in claim 10, and comprising:

the recesses intersect each other along the center of the strip.

* * * * *